United States Patent [19]

Giudici

[11] Patent Number: 4,687,454

[45] Date of Patent: Aug. 18, 1987

[54] METHOD AND DEVICE FOR HEATING THE ELECTRODES OF AN ELECTRON GUN DURING ITS MANUFACTURE

[75] Inventor: Giuliano Giudici, Rome, Italy

[73] Assignee: Videocolor, Montrouge, France

[21] Appl. No.: 875,730

[22] Filed: Jun. 18, 1986

[30] Foreign Application Priority Data

Jun. 21, 1985 [FR] France ..... 8509502

[51] Int. Cl.[4] ..... H01J 9/39; H01J 9/44

[52] U.S. Cl. ..... 445/5

[58] Field of Search ..... 445/5, 6

[56] References Cited

U.S. PATENT DOCUMENTS

| | | | |
|---|---|---|---|
| 4,392,834 | 7/1983 | Smith | 445/6 |
| 4,395,242 | 7/1983 | Liller et al. | 445/5 |
| 4,395,243 | 7/1983 | Toyama et al. | 445/6 |
| 4,406,637 | 9/1983 | Hernqvist | 445/6 |
| 4,410,310 | 10/1983 | Halbrook . | |
| 4,515,569 | 5/1985 | Hernqvist | 445/6 X |

FOREIGN PATENT DOCUMENTS

| | | |
|---|---|---|
| 0130874 | 9/1985 | European Pat. Off. . |
| 57-208037 | 12/1982 | Japan . |

OTHER PUBLICATIONS

Patent Abstract of Japan, vol. 7, No. 62 (E-164) [1207] Mar. 15, 1983.

*Primary Examiner*—Kenneth J. Ramsey

*Attorney, Agent, or Firm*—Oblon, Fisher, Spivak, McClelland & Maier

[57] ABSTRACT

Method for heating the first electrodes of electrostatic lenses of the bi-potential type of an electron gun forming part of a cathode ray tube, this heating being performed during manufacture of the tube and wherein the first electrodes of the two lenses are brought to a same potential and the second electrodes are also brought to a same potential but at a value different from that of the first one and the electrons produced by the gun are used for heating the first electrode of each lens at its end adjacent to the second electrode of this same lens.

10 Claims, 2 Drawing Figures

METHOD AND DEVICE FOR HEATING THE ELECTRODES OF AN ELECTRON GUN DURING ITS MANUFACTURE

BACKGROUND OF THE INVENTION

1. Field of the invention

The present invention concerns a method and a device for manufacturing a cathode ray tube. It concerns more particularly the heating of electrodes of electrostatic lenses of the electron gun, this heating being intended to eliminate the gaseous particles of the bulb under vacuum.

2. Description of the prior art

It is known that a cathode ray tube, especially a color television tube, comprises at least one electron gun in order to stimulate the cathodoluminescent materials (phosphors) on the screen. Said electron gun(s) is(are) disposed to the rear of the tube in a narrowed cylindrical part.

Such an electron gun comprises an emitting cathode heated by a filament and an assembly of electrodes, generally called grids, certain of which constitute electrostatic lenses. This assembly comprises an electrode or Wehnelt cylinder $G_1$ raised to a variable voltage, usually negative with respect to the cathode, to order the extraction of the electrons, especially their quantity, a second electrode $G_2$ for accelerating the electrons beams and two electrostatic lenses for concentrating the beam.

The invention concerns the case where each lens is of the bi-potential type, the first of said lenses comprising two electrodes $G_3$ and $G_4$, one of which $G_3$, which immediately follows (towards the screen) the electrode $G_2$, has an elongated form and is raised to a potential of about +7 kV and the other $G_4$, which has a relatively flattened form in the example, and is raised to a potential of about +25 kV. The second lens for concentrating the beam is formed of two electrodes having an elongated form of which the first $G_5$, which immediately follows the electrode $G_4$ is brought to the same potential as the first electrode $G_3$ of the first lens and of which the second lens $G_6$ is raised to the same potential, of about +25 kV, as electrode $G_4$ of the first lens.

During manufacture of the tube, after installation of the gun and the putting under vacuum of the bulb, the cathode(s) is(are) heated to a normal operating temperature in order to shape and stabilize the material forming this cathode and thereafter voltages are applied to the electrodes in order to heat said electrodes and thereby clean the tube, through elimination of the undesirable gaseous particles, especially the particles included in the metal forming the electrodes, all these particles being absorbed by a capsule called a getter.

It is important that this cleaning be carried out thoroughly since, in the event of incomplete cleaning, during normal working of the tube an after-glow phenomenon appears in the form of a luminous emission during a considerable time after switching off the television receiving set (or other visualization device) fitted with the tube.

SUMMARY OF THE INVENTION

The invention results from the observation that the particles responsable for this phenomenon are in particular those which are included in the metal of the grids $G_3$ and $G_5$ adjacent to respective grids $G_4$ and $G_6$ since, in these areas, the accelerator electrical field has a very high intensity. It is therefore necessary, according to the invention, to localize with a view to their cleaning, the heating of the grids $G_3$ and $G_4$ at these sites, i.e. at their ends adjacent of the grids, respectively $G_3$ and $G_6$.

It is already known to heat an electrode, to use electrons produced by the cathode and thus to apply a voltage between this cathode and the grid to be heated. In the preferred embodiment, this heating process is used. But, in order to localize this heating as desired on one of the ends of the electrode $G_3$ or the electrode $G_5$ it is necessary, according to the invention, to take particular provisions. These provisions consist in applying a same negative or voltage potential on the electrodes $G_4$ and $G_6$; the value of this potential determines the site of heating. Therefore, on one example, is applied to grids $G_3$ and $G_5$, which are electrically connected to each other, a potential or voltage of 800 to 1000 volts and the electrodes or grids $G_4$ and $G_6$ which are also electrically connected to each other are raised to a potential of about −1300 volts in order to heat the end of the grid $G_3$ adjacent to $G_4$ and to a potential of −900 volts in order to heat the end of the grid $G_5$ adjacent to $G_6$.

BRIEF DESCRIPTION OF THE DRAWING

Other features, objects and advantages of the present invention will become apparent from the following description of certain embodiments, given with reference to the appended drawing in which.

DESCRIPTION OF THE PREFERRED EMBODIMENT

Figure 1:
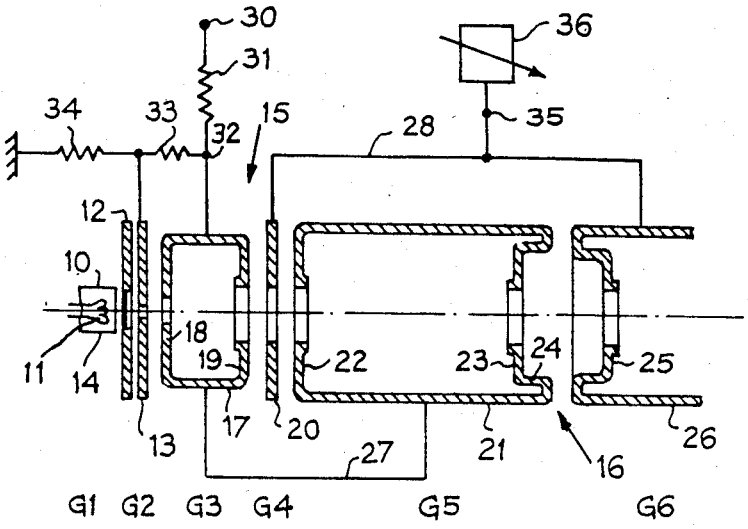
FIG. 1 is a diagram of a color television electron gun during processing according to the invention.

The example that will be described herein-below with reference to the figures concerns the manufacture of a color television tube of the mask type with three electron guns. However, for enhanced simplicity, only a single gun has been represented in FIG. 1.

This gun comprises an emitting K cathode 10 to which is associated a heating filament 11, an electrode 12 or Wehnelt cylinder $G_1$ raised to a variable potential, generally negative with respect to that of the cathode in order to control extraction of the electrons and, after this electrode $G_1$, an electrode $G_2$ referenced 13 in order to accelerate the beam.

These electrodes $G_1$ and $G_2$ are made of metal and have a flattened form. Each of the electrodes $G_1$ and $G_2$ has an opening of restricted size to let the electron beam pass therethrough.

After the electrode 13 ($G_2$) in the emitting direction of the beam, according to the axis 14 of the tube, the gun comprises two electrostatic lenses 15 and 16 for concentrating the beam. Each of these lenses is of the bi-potential type.

The first lens 15 comprises a first electrode $G_3$, referenced 17, having the form of a tube with two end walls 18 and 19, the opening of the wall 18, adjacent to the grid $G_2$ having a section smaller than that of the opening of the wall 19, adjacent to the grid $G_4$. The second electrode $G_4$ (20) has a flattened form. Its opening has the same section as that of the opening of the wall 19.

The second electrostatic lens 16 also presents two electrodes the first $G_5$ of which placed immediately after electrode $G_4$, has the form of an elongated tube, having a greater length than the electrode $G_3$, with two ends walls the first 22 of which, adjacent to the electrode $G_4$ has an opening of the same section as that of this electrode $G_4$ and the second 23 of which also has an opening of the same section but presents a recess 24 towards the inside of the tubular part 21, the opening of the wall 23 thus being slightly withdrawn with respect to the end of the tube 21.

The second electrode $G_6$ of the lens 16 also has a tubular form with an end face 25 presenting an opening of the same section as that of the face 23; the face 25 is withdrawn towards the inside of the tube 26 constituting the electrode $G_6$.

An electrical connection 27 connects the electrodes $G_3$ and $G_5$. Furthermore, the electrodes $G_4$ and $G_6$ are connected by an electrical lead 28.

During normal working electrodes $G_3$ and $G_5$ are raised to a potential of about +7000 volts while electrodes $G_4$ and $G_6$ are raised to a potential of about +25000 volts.

During manufacture of the color television tube, the electrodes $G_3$ and $G_5$ are connected to a device for heating the electrodes analogous to the device. This device comprises a voltage source applying, at a terminal 30, a potential of about +1800 volts. This terminal 30 is connected to the electrodes $G_3$ through the intermediary of a resistor 31 having here a value of 38 KΩ. The terminal 32 common to the resistor and to the electrode $G_3$ is connected to the electrode $G_2$ through the intermediary of a resistor 33 having here a value of 470 KΩ and this resistor is itself earthed through the intermediary of a resistor 34 having here a value of 350 KΩ.

According to an important provision of the invention, during manufacture of the tube head 28 and/or the electrodes $G_4$ and $G_6$ is(are) connected to a terminal 35 itself connected to a generator 36 which supplies, on this terminal 35, a negative potential of variable value between −900 volts and −1300 volts, in the example.

Figure 2:
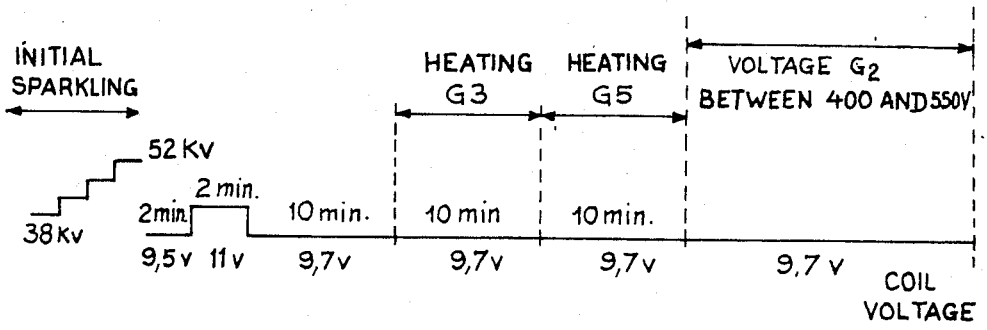
FIG. 2 is a diagram showing the various processing steps.

For shaping and stabilizing the material of the cathode and for cleaning, the same procedure as represented in FIG. 2 is adopted which shows the various operations with their respective durations. First, a sparking is carried out which consists in applying a high voltage, comprised between 38 kV and 52 kV, between grids $G_4$ and $G_6$ and the other grids and the cathode which are earthed. Immediately after this sparking, a preliminary heating of the cathode is carried out during 2 mm; with this aim, the voltage applied to this filament 11 is 9.5 volts whereas its nominal voltage is slightly higher: 9.7 volts. After this preliminary heating, the cathode(s) is(are) heated to a temperature higher than normal working temperature in order to shape and stabilize the material constituting the cathode. For this operation, the filament is fed under a voltage of 11 volts during 2 minutes. After a stabilizing period of 10 minutes during which the filament is fed under a voltage of 9.7 volts, the grids $G_3$, then $G_5$ are heated by electron bombardment.

With this purpose, the filament 11 is under a voltage of 9.7 volts the cathode 10 is earthed, on the grid $G_2$ is applied a potential of about +400 volts and on the grid $G_3$ (and thus also on the grid $G_5$) a potential of about +800 to +1000 volts, the potential of the terminal 30 being about 1800 volts.

It will be noted that if the electrodes $G_4$ and $G_6$ are not polarized, i.e. if the terminal 35 is not connected to a source, the electrons reach the electrode $G_5$ in the vicinity of its end 22 adjacent to the electrode $G_4$. In this case, it is mainly this end which is heated whereas the most sensitive parts of the electrodes $G_3$ and $G_5$ are raised to a temperature which is too low to allow elimination of the harmful particles which are responsable for the after glow phenomenon.

In order to localize heating of the electrode $G_3$ (17) in the vicinity of its end wall 19, adjacent to the electrode $G_4$, where the most intense electrical field prevails, a potential of −1300 volts is applied on the terminal 35 and thus on the electrodes $G_4$ (20) and $G_6$ (26). With this negative value of potential, electrode $G_4$ constitutes a barrier to the electrons which therefore cannot reach the electrode $G_5$.

To carry out the heating of the end of the electrode $G_5$ adjacent to its wall 23, and thus adjacent to the electrode $G_6$, the potential applied to its terminal 35 is about −900 volts. Under these conditions, the negative potential applied to the electrode $G_4$ has an absolute value sufficiently low so as not to prevent the electrons from crossing through this electrode $G_4$. These electrons which have crossed through electrode $G_4$ are thereafter repelled by this negative potential. This is the reason why they can reach the opposite end of the electrode $G_5$ in order to heat it. These electrons are also repelled by the negative potential on the electrode $G_6$.

In both these cases, i.e. with the terminal 35 at the potential of −1300 volts then at the potential of −900 volts, the areas hit by the electrons reach temperatures of about 800° C., which are sufficient to obtain a high-quality degasifying.

The heating of the grid $G_3$ is carried out during about 10 minutes. Similarly, the duration of the heating of grid $G_5$ is about 10 minutes.

It is to be noted that the value of the voltage applied to the terminal 30 as well as the values of the resistors 31, 33 and 34 allow as described in French Pat. No. 83 10503, to overcome the variations on the dimensions of the cathodes and the grids or electrodes as well as variations of distances between the cathode and the various grids, which are inevitable during large scale manufacture. In other words, despite the variations in dimensions, the concerned areas of the electrodes $G_3$ and $G_5$ still reach at least temperatures of 800° C. It is necessary, to overcome the variations, to select the voltage applied to the terminal 30 at a value sufficiently high and to put in series with the generator connected to the terminal 30 a resistor of sufficiently high value, for example, at least of the same order of value as the average dynamic resistor between the cathode and the grid $G_3$.

The apparatus and the method described are particularly simple to carry out. They do not require extensive modification of equipment for manufacturing color television tubes. In order to pass from the heating of the grid $G_3$ to the heating of the grid $G_5$ it is only necessary to carry out a simple switching of the potential applied to the terminal 35.

I claim:

1. Method for heating the first electrodes of two electrostatic lenses of the bi-potential types of an electron gun forming part of a cathode ray tube, this heating being carried out during the manufacture of the tube, the first electrodes of these two lenses being brought to the same potential and the second electrodes also being brought to a same potential, but of a value different to that of the first, method in which, for the heating, use is made of the electrons produced by the gun, wherein the heating of the first electrode of each lens is localized at its end adjacent to the second electrode of this same lens.

2. Method according to claim 1, wherein to localize the heating on the end of the first electrode of the first lens which is adjacent to the second electrode of that same lens, on this second electrode is applied a negative potential sufficiently high in absolute value to prevent the electrons from crossing through this second electrode.

3. Method according to claim 1, wherein to localize the heating on the end of the first electrode of the second lens adjacent to the second electrode of this same lens, a same negative potential is applied to the second electrodes of the two lenses, this negative potential having an absolute value that is sufficiently low for the electrons to cross through the second electrode of the first lens but sufficiently high that the second electrode of the second lens repells these electrons.

4. Method according to claim 2, wherein the potential of the first electrode of the first lens being about 800 to 1000 volts, the potential of the second electrode of this first lens is about −1300 volts during heating of this first electrode.

5. Method according to claim 3, wherein for the heating, the potential of the first electrodes of the electrostatic lenses being about 800 to 1000 volts, during heating of the first electrode of the second lens the potential applied to the second electrodes of these lenses is about −900 volts.

6. Method according to claim 4, wherein the heating of the first electrode of the first lens is carried out during about 10 minutes.

7. Method according to claim 5, wherein the heating of the first electrode of the second lens is carried out during about 10 minutes.

8. Method according to claim 1, wherein the heating of the first electrodes of the electrostatic lenses is carried out immediately after the shaping and stabilizing operation of the material of the electron gun cathode.

9. Method according to claim 1, wherein the parameters of the supply circuit are selected so that the intensity of the current for heating the electrodes is practically insensitive to the variations of size of the cathode and the electrodes and to the variations of distances between the cathode and the electrodes in order that the temperature reached by the electrodes remains higher than a determined threshold, for example of about 800° C.

10. Method for heating the first electrodes of two electrostatic lenses of the bi-potential type of an electron gun forming part of a cathode ray tube, this heating being carried out during manufacture of the tube, the first electrodes of these two lenses being raised to a same potential and the second electrodes also being raised to a same potential but of a value different to that of the first one, method in which for the heating, use is made of electrons produced by the gun, wherein the heating of the first electrode of each lens being localized at its end adjacent to the second electrode of this same lens, to localize the heating on the end of the first electrode of the first lens which is adjacent to the second electrode of this same lens is applied on this second electrode a negative potential sufficiently high in absolute value to prevent the electrons from crossing through this second electrode, and wherein to localize the heating on the end of the first electrode of the second lens adjacent to the second electrode of this same lens, on the second electrodes of the two lenses are applied a same negative potential which, in absolute value, is sufficiently low so that the electrons can cross through the second electrode of the first lens but sufficiently high so that the second electrode of the second lens repells the electrons.

* * * * *